US005163555A

United States Patent [19]

West et al.

[11] Patent Number: 5,163,555

[45] Date of Patent: Nov. 17, 1992

[54] HAZARDOUS WASTE DISPOSAL CONTAINER

[75] Inventors: Thomas M. West, Greenfield Center, N.Y.; Thomas Morrison, Monmouth Beach, N.J.

[73] Assignee: Georgia-Pacific Corporation, Atlanta, Ga.

[21] Appl. No.: 685,093

[22] Filed: Apr. 17, 1991

Related U.S. Application Data

[63] Continuation-in-part of Ser. No. 593,671, Oct. 11, 1990, abandoned.

[51] Int. Cl.[5] ..... B65D 19/06

[52] U.S. Cl. ..... 206/386; 206/600; 229/138; 220/410; 220/462

[58] Field of Search ..... 206/600, 524.1, 524.5, 206/386; 229/137, 138, 23 R; 220/462, 443, 441, 410

[56] References Cited

U.S. PATENT DOCUMENTS

| | | | |
|---|---|---|---|
| 3,248,039 | 4/1966 | Locke | 229/137 X |
| 3,744,702 | 7/1973 | Ellison | 229/23 R |
| 4,174,803 | 11/1979 | Shrontz et al. | 229/23 R X |
| 4,260,071 | 4/1981 | Bamburg et al. | 220/443 X |
| 4,324,333 | 4/1982 | Porter | 220/462 X |
| 4,426,015 | 1/1984 | Preston et al. | 220/462 X |
| 4,525,100 | 6/1985 | Zawadzki, Jr. et al. | 405/129 |
| 4,712,687 | 12/1987 | Silcott et al. | 206/600 |
| 4,742,951 | 5/1988 | Kelly et al. | 229/23 R |
| 4,838,418 | 6/1989 | Teixeira | 229/23 R X |
| 4,858,822 | 8/1989 | Johnson et al. | 229/137 |

*Primary Examiner*—Paul T. Sewell
*Assistant Examiner*—Jacob K. Ackon, Jr.
*Attorney, Agent, or Firm*—Banner, Birch, McKie & Beckett

[57] ABSTRACT

The present invention is a collapsible, multi-wall fiberboard container which is fixedly attached to a pallet. The container is particularly designed to hold flowable type materials such as sludge or particulates, and may be used for containing, transporting, storing or disposing of hazardous waste. The container is preferably a double wall, tubular member having opposed side panels and opposed end panels, with the end panels being generally normal to the side panels. The container also includes top and bottom flaps hingedly connected to the end and side panels. Three of the bottom flaps are formed as a half bellows. The remaining bottom flap is adapted to be attached to a pallet. Preferably, the top flaps are also of a regular slotted design. Laminated and glued to the interior of the container is a triple wall reinforcing member in the preferred embodiment. A polybag liner may be used in the container.

9 Claims, 4 Drawing Sheets

HAZARDOUS WASTE DISPOSAL CONTAINER

This application is a continuation-in-part of application Ser. No. 07/593,671 filed Oct. 11, 1990 entitled "Hazardous Waste Disposal Container" which is now abandoned.

BACKGROUND OF THE INVENTION

The present invention relates to a hazardous waste disposal container and, more particularly, to a collapsible container for a disposable hazardous waste packaging system.

The disposal of hazardous waste materials is a pressing social problem. For many years, disposal of hazardous wastes was not closely regulated or supervised. As a result, many waste materials were disposed of improperly, with consequent damage to persons or the environment.

Today, the three most common methods of properly disposing of hazardous waste materials are: (1) to chemically treat the hazardous waste and render it harmless; (2) to store or bury the hazardous waste; or (3) to incinerate the hazardous waste. A suitable container is used in methods (2) and (3) above. The present invention is directed to an improved container for storing or incinerating hazardous waste materials.

Containers generally used today for the disposal of hazardous waste materials are metal, plastic, or fiber drums. Plastic sacks, known as "super sacks", are also used for storing small quantities of hazardous waste materials, e.g., up to one ton. Stainless steel reusable containers are also used in some instances. All of these known containers have some drawbacks. The "super sacks" do not stack well for transportation and storage and have significant strength limitations. Drums, in general, do not store efficiently because of their round shape, which leaves significant unused, valuable storage space. In the vernacular of the disposal industry, this is referred to as not "cubing". Additionally, metal and plastic drums are expensive. Stainless steel reusable containers are expensive and need a great deal of maintenance. Accordingly, a need exists for an inexpensive, safe, efficient, and effective container for the disposal of hazardous waste materials.

The present invention is a collapsible, fiberboard, pallet mounted container particularly adapted for disposing of hazardous waste materials. Although numerous fiberboard containers are well-known for a variety of applications, it is unusual to use fiberboard containers for hazardous waste materials because of the rigorous vibration, impact, compression, and dynamic requirements for hazardous waste containers before they are acceptable for disposing of hazardous waste materials. Known fiberboard containers which might be sufficiently strong to meet these rigorous requirements would not be readily collapsible for ease of storage and transportation, nor would they provide convenient, effective, and safe means for securing the container to a pallet.

For example, it is known that corrugated paper board containers or boxes can be attached to a pallet to create a packaging system which can be moved easily by a forklift truck. Such a packaging system allows for convenient storage in a warehouse in a stacked condition and efficient transport by truck. However, most of these known containers are not suitable for disposing of hazardous waste.

One such example of a known container and pallet packaging system is shown in Silcott, et al., U.S. Pat. No. 4,712,687. Silcott, however, would not be suitable for hazardous waste. Silcott is directed to a collapsible, pallet-mounted container. Central score lines extend completely across the end panels and the bottom width flaps, so as to divide the end panels and each bottom width flap into halves. The central score lines enable the container, when attached to the pallet, to be folded against the pallet for transportation or storage prior to use. A disadvantage to this container is that the central score lines weaken the sidewalls and thus permit the container to readily collapse when the container is assembled in its upright position. This, of course, increases the difficulty of filling the container and may allow the contents of the container to spill. When the container is used for storing hazardous waste materials, such spillage can be dangerous to persons and the environment. The present invention provides a stronger, easier and safer to use collapsible container. Also, in Silcott, one half of each width flap includes a single diagonal score line which extends from the central score lines to the adjacent side panel. These width flaps are not, however, fixed to the pallet to create a half bellows bottom, as in the present invention.

Another example of a container which is attached to a pallet is Zawadzki, Jr. et al., U.S. Pat. No. 4,525,100. The container in Zawadzki is particularly directed to a method of transportation and disposal of waste materials. The container disclosed by Zawadzki is a paper board container that is sprayed with a waterproof coating or can include a fluid impervious liner bag. The container is attached to a series of wood slats or support rails. The container is cubically-shaped thus allowing for a greater packing efficiency than cylindrical drums. When the containers are placed within a landfill, excess moisture, such as rain water, saturates the containers and causes them to slump down. Thus, the containers can be compacted to account for the settling of the waste material contained in the container. The specific configuration of the container is not disclosed by Zawadzki. Zawadzki also does not disclose a collapsible container. Additionally, there is no disclosure of how the container is fixed to the pallet.

SUMMARY OF THE INVENTION

The present invention is a collapsible, multi-wall fiberboard container which is fixedly attached to a pallet. The container is particularly designed to hold flowable type materials such as sludge or particulates, and may be used for containing, transporting, storing or disposing of hazardous waste. However, it will be apparent that the invention is not particular restricted to the contents of the container. The container preferably includes a double wall, tubular body member having opposed side panels and opposed end panels, with the end panels being generally normal to the side panels. The container also includes top and bottom flaps hingedly connected to the end and side panels. Three of the bottom flaps are constructed to form a half bellows bottom closure. The fourth bottom flap is adapted to be fixed to a pallet. Preferably, the top flaps are of a regular slotted design. Laminated and glued to the interior of the container is a triple wall reinforcing member in the preferred embodiment. The triple wall reinforcing member of the present invention, in conjunction with the double wall of the body member, provides increased strength without causing the flexibility and folding problems associated with very thick, multiple wall type containers.

The half bellows bottom closure is formed by a pair of intersecting diagonal fold lines one of the bottom side flaps. These diagonal fold lines extend from adjacent the intersections of the fold line between the bottom side flap and its corresponding side panel to the outer edge of the side flap.

A polyethylene bag or polybag is also provided to contain the flowable or particulate material. In the preferred form of the invention, up to 2,500 pounds of hazardous waste may be held in the polybag. A water or fluid impervious material can be sprayed or coated on the interior of the container to limit absorption of condensation. A container formed in accordance with the present invention eliminates all sharp internal edges which may puncture the polybag, as will be further explained below.

The half bellows bottom closure is formed by three adjacent bottom flaps. The half bellows bottom closure allows the container to be easily erected on a pallet by attaching, such as by nails, the bottom flap that does not form a part of the half bellows bottom to a pallet. The nails can then be covered with the other flaps, which further eliminates the danger of puncturing the polybag liner.

Using the present invention, the containers and pallets can be shipped separately in unattached condition and assembled on site. This saves storage space and reduces the cost of transportation. Additionally, when the container is attached to the pallet and folded into an upright position, the container remains in an open position so it may be safely and effectively filled. Furthermore, the bellows bottom closure allows the container to be attached to the pallet without providing a sharp edge which could puncture the polybag liner. The ability to use fasteners such as nails to attach the container to the pallet substantially increases the ease and cost-effectiveness of assembly and eliminates the need for cumbersome and expensive straps, which are typically used to attach a hazardous waste container to a pallet.

Containers formed in accordance with the present invention satisfactorily meet or exceed all vibration impact, compression, and dynamic requirements for hazardous waste containers. Containers of the invention have a greater stacking efficiency over conventional drums, which reduces the amount of wasted storage and shipping space. The present invention also is far more cost effective than metal and stainless steel drums. Also, a container made in accordance with the present invention provides increased end use options, since it can be ultimately disposed of by storage or by incineration, which is not possible for metal or stainless steel drums.

The invention is pointed out with particularity in the claims annexed hereto and forming a part hereof. However, for a better understanding of the invention, its advantages, and objects obtained by its use, reference should be had to the drawings which form a further part hereof, and to the accompanying descriptive matter, in which there are illustrated and described preferred embodiments of the invention.

DETAILED DESCRIPTION

Figure 1:
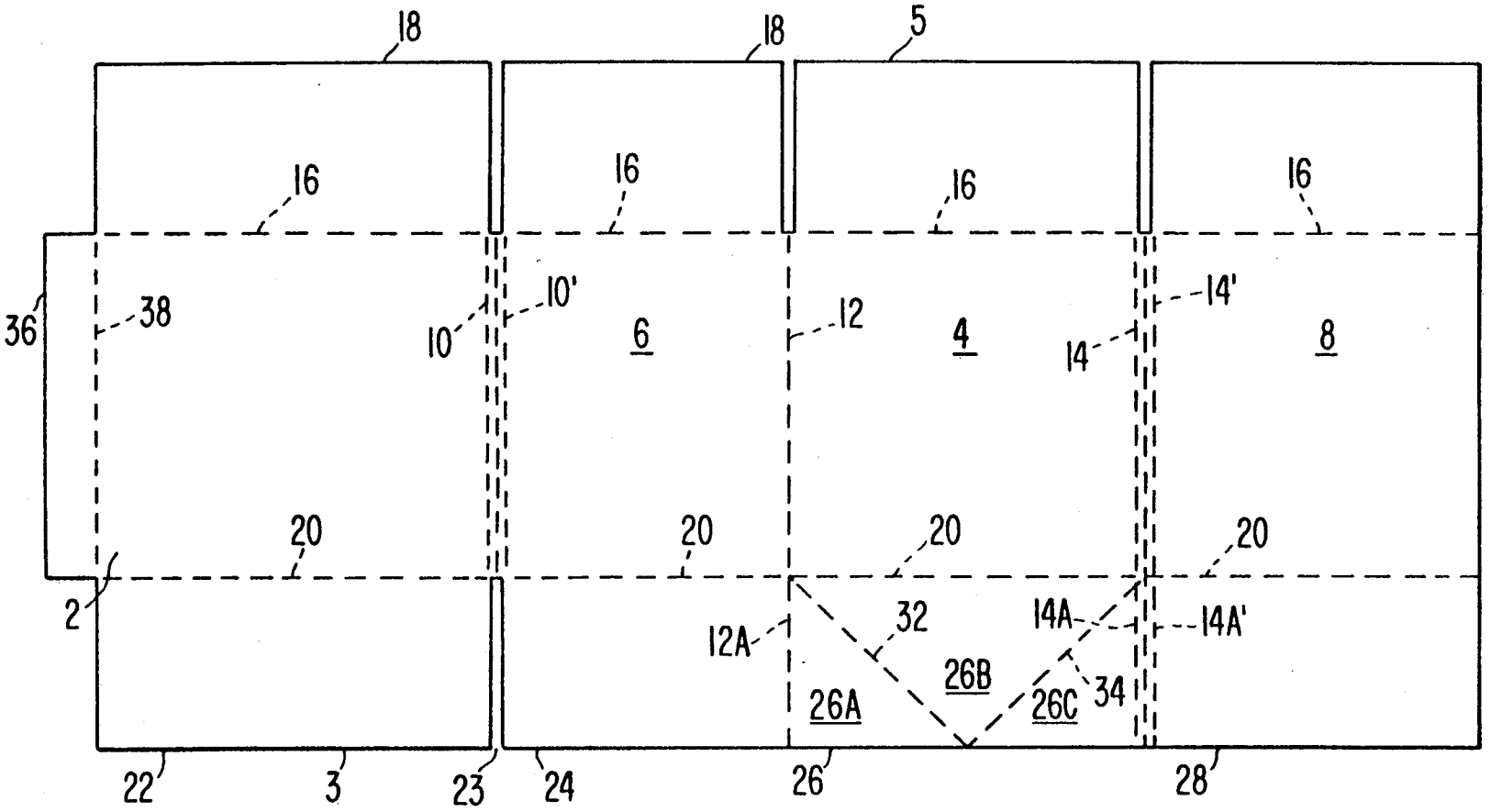
FIG. 1 is a plan view of a container blank.

Referring to the drawings, wherein like numerals indicate like elements, a container blank 1 is shown in FIG. 1 having a bottom edge 3 and a top edge 5. Container blank 1 in the preferred embodiment is preferably of double wall thickness and includes side panels 2 and 4 and end panels 6 and 8. Side panel 2 is connected to end panel 6; end panel 6 is connected to side panel 4; side panel 4 is connected to end panel 8. Side panel fold lines 10 and 10' extend from fold line 16 to fold line 20 and delineate side panel 2 from end panel 6. A transverse fold line 12 extends from the bottom edge 3 of blank 1 to fold line 16 and delineates end panel 6 from side panel 4. Two transverse fold lines 14, 14' extend from bottom edge 3 to fold line 16 and delineate side panel 4 from end panel 8. An end flap 36 is delineated from side panel 2 by an end flap fold line 38. When container blank 1 is folded along the fold lines, end flap 36 is glued, taped or otherwise attached to end panel 8 to thus form a tubular body having a generally square cross-section. A glued joint is preferred between flap 36 and panel 8 to eliminate any sharp edges that could tear a polybag placed within the container.

Top flaps 18 are connected to the side and end panels and delineated therefrom by a top longitudinal fold line 16. Top flaps 18 are preferably a regular slotted design, as shown in the drawings.

Fastening bottom flap 22 and bellows bottom flaps 24, 26 and 28 are delineated from the side panels 2, 4 and end panels 6, 8 by bottom longitudinal fold line 20. A slot 23 separates flap 22 from flap 24. Bottom flap 22 is preferably of a regular slotted design similar to top flaps 18. Bottom flaps 24, 28 are separated from bottom flap 26 by bottom flap fold lines 12A, 14A and 14A', respectively, which are extensions of fold lines 12, 14 and 14', respectively. In other words, bottom flap 24 is separated from bottom flap 26 by a bottom flap fold line 12A. Bottom flaps 26 and 28 are separated by bottom flap fold lines 14A and 14A'. Bottom flap fold line 12A is an extension of fold line 12. Bottom flap fold line 14A is an extension of fold line 14 and bottom flap fold line 14A' is an extension of fold line 14'.

A pair of diagonal fold lines 32 and 34 are formed on bottom flap 26. Diagonal fold line 32 extends from the intersection of bottom longitudinal fold line 20 and transverse fold line 12 to the outer edge of bottom flap 26. Diagonal fold line 34 extends from the intersection of bottom longitudinal fold line 20 and transverse fold lines 14 and 14' to the outer edge of bottom flap 26. Thus, it can be seen in FIG. 1 that the diagonal fold lines 32, 34 create three triangularly shaped portions 26A, 26B and 26C, referred to for convenience as the inner portion, middle portion, and outer portion, respectively. When folded on the diagonal fold lines, flap 26 together with flaps 24 and 28 form a half bellows bottom closure. In the preferred embodiment the diagonal fold lines are positioned such that they extend at an angle of 45° with reference to bottom longitudinal fold line 20.

Figure 2:
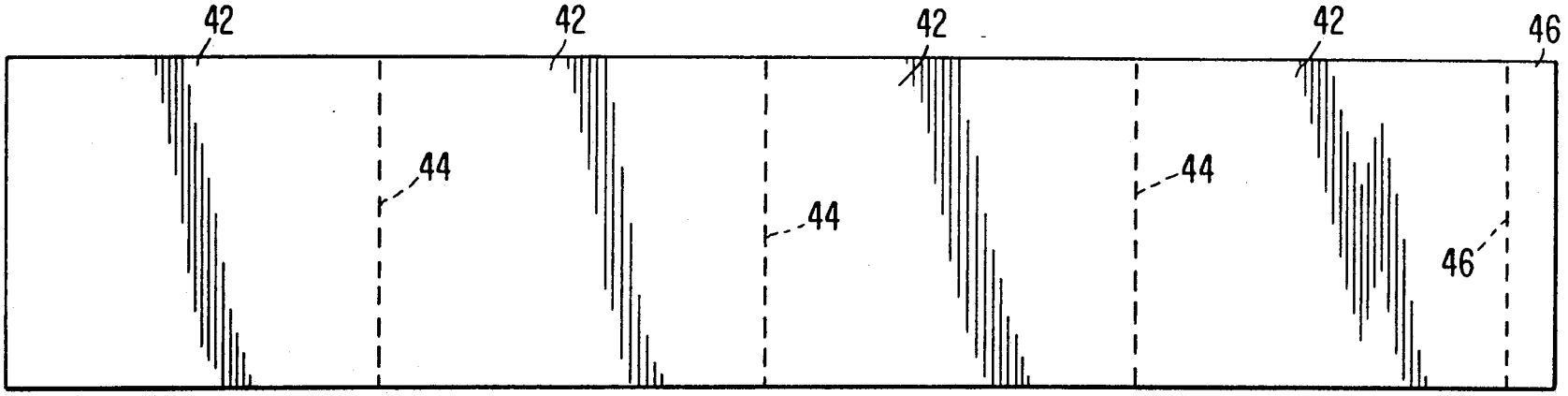
FIG. 2 is a plan view of a reinforcing member blank.

A reinforcing member 40, is shown in FIG. 2. In the preferred embodiment reinforcing member 40 is formed of triple wall thickness corrugated fiberboard. Preferably, the reinforcing member is composed of four side panels 42 which are delineated from each other by fold lines 44. An end flap 46 is attached to one of the inner side panel members 42 when the reinforcing member is constructed, in a manner similar to the attachment of end flap 36 to end panel 8. Reinforcing member 40 and the outer member or blank 1 are laminated to each other, to thereby eliminate any sharp edges that could tear the poly bag.

Figure 4:
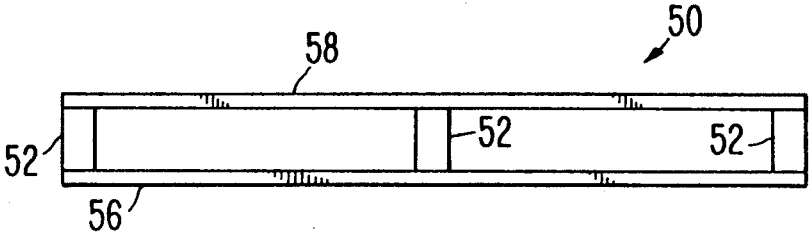
FIG. 4 is a front view of the pallet of FIG. 3.
Figure 3:
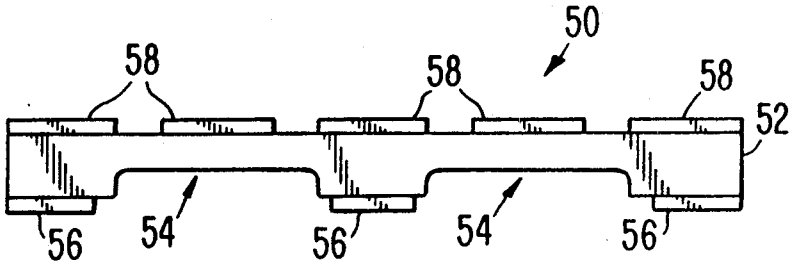
FIG. 3 is a side view of a pallet used in the present invention.

FIGS. 3 and 4 disclose a typical pallet member which can be used to support the container of the invention. Pallet 50 consist of three stringer members 52 that are formed with forklift cutouts 54 which allow the forks of a forklift to be inserted below the stringers to enable lifting of the pallet. A bottom deck is formed by bottom deck members 56 and a top deck is formed by top deck members 58. The top and bottom deck members are attached to stringers 52 by nails, staples or some other means of attachment. Of course, other pallet structures can also be used.

Figure 5:
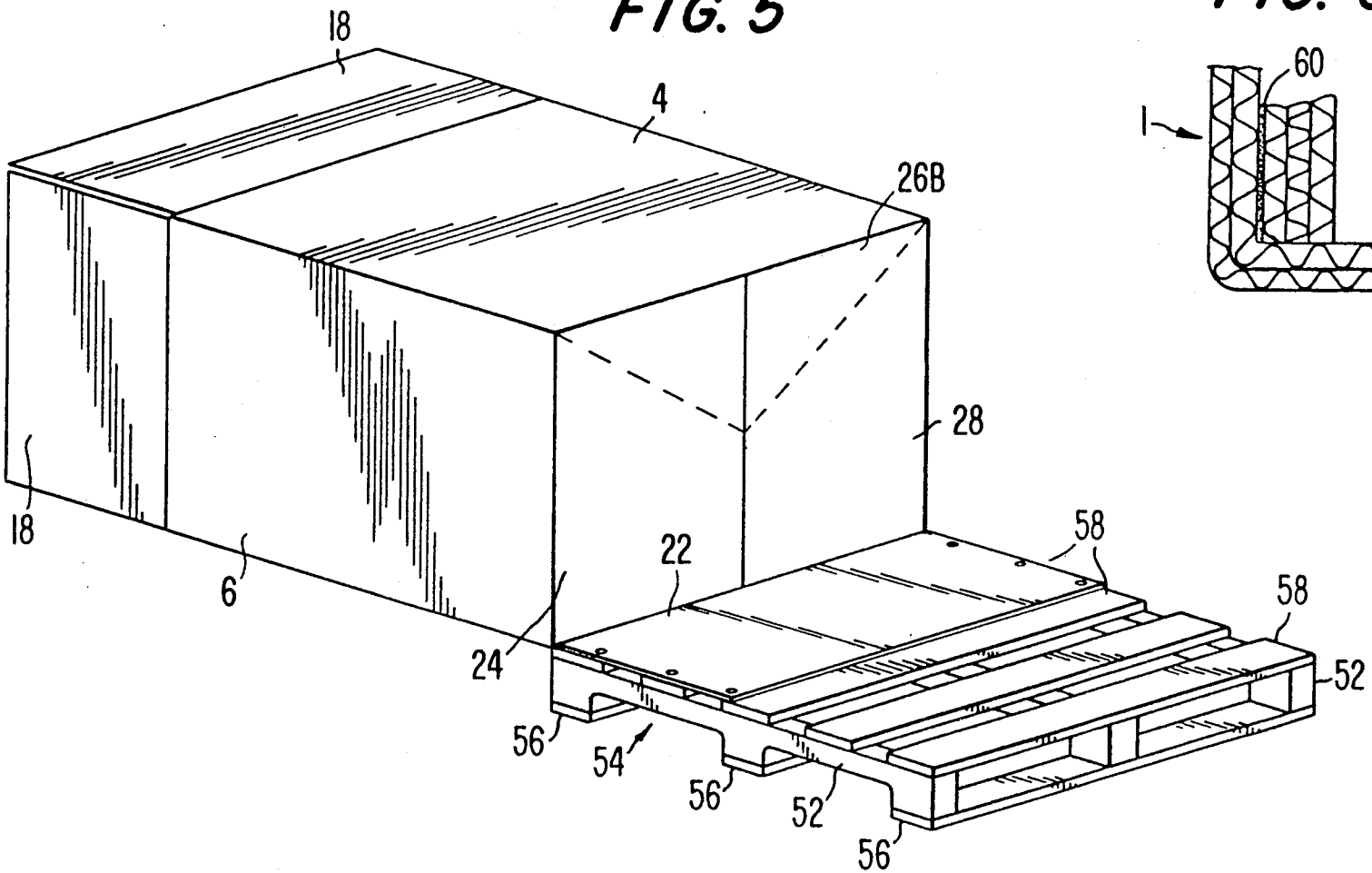
FIG. 5 is a perspective view showing the container in a partially assembled position attached to the pallet.
Figure 7:
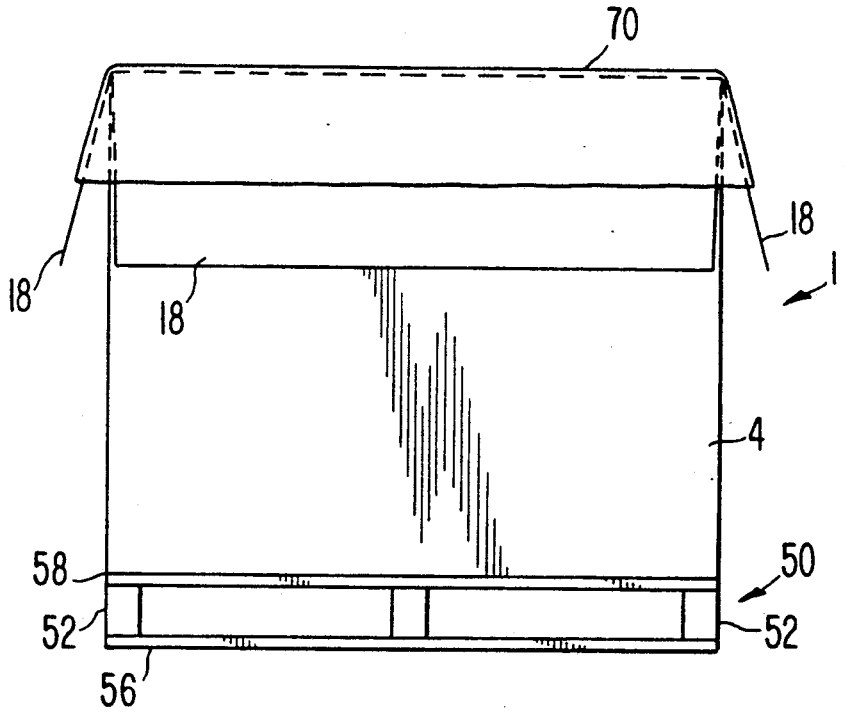
FIG. 7 is a front view of the container and pallet in the assembled upright position.

FIG. 5 illustrates the container being attached to the pallet 50. The container is constructed by first folding along the transverse and side panel fold lines and attaching end flap 36 to end panel 8, to thereby form a tubular container body. The fastening bottom flap 22 is then attached to pallet 50 by staples, nails or similar means of attachment. This eliminates the need to use straps to hold the container to the pallet. Then, bottom flap 26, a middle one of the three half bellows bottom flaps 24, 26 and 28, is folded such that its middle portion 26B is perpendicular to side panel 4. Bottom flap portions 26A, 26C are then folded along the diagonal fold lines 32, 34. Half bellows bottom flaps 24, 26 and 28 are then folded inwardly. When container blank 1 is folded in this manner, bottom flaps 24 and 28 cover bottom flap 22 to eliminate any sharp edges which might be present because of the nails or staples.

Once the bottom of the container is formed the container is then moved to the upright position where it is positioned over pallet 50. Liner 70, preferably in the form of a polyethylene bag, is then positioned within the container such that flowable material can be placed in the container. The interior of the container also can be coated with a fluid-impervious material to inhibit the absorption of condensation. Liner 70 can then be filled with the flowable material and then securely fastened. The smooth interior of the container prevents punctures of liner 70. The top flaps are then closed in conventional fashion.

As one example of the specific container made according to the present invention, the blank 1 can be formed of 350 lb. test, CB flute, double wall corrugated fiberboard. The inner reinforcing member 40 can be composed of 1100 lb. test, Class 2 CAA triple wall corrugated fiberboard. The container blank and reinforcing member are laminated or glued to each other and glued at the end flaps by means of a 4-inch wide glue flap. A waterproof glue is preferred.

Figure 6:
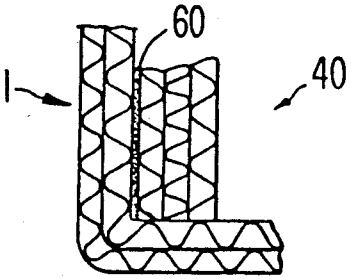
FIG. 6 is a section view showing the reinforcing member attached to the container wall.

FIG. 6, illustrates the attachment of triple wall corrugated fiberboard reinforcing member 40 to blank 1. A polybag is positioned and contained inside of the reinforcing member. In a preferred form, the polybag would have a minimum thickness of 0.0065 inches and would contain no more than 2,500 pounds of material. The type of fiberboard that is used and the various strength characteristics of the corrugated fiberboard and polybag can be varied according to the design requirements and the material to be carried.

The double wall/triple wall tube-type corrugated fiberboard container, polybag, and pallet packaging system of the present invention can be used for transporting hazardous waste type materials such as poison B solids and other types of flowable materials. The container can meet all performance requirements for safely shipping hazardous waste. The container provides sufficient strength so that when erected it is held in a fixed open position, thereby facilitating filling the polyethylene bag. Waste material is not inadvertently dumped on the ground due to the container not being in a fully open condition. The container is easy to set-up and safe to handle. Additionally, nails or staples can be used to attach the container to the pallet and the remaining bottom flaps can be used to cover any sharp edges. The reinforcing member is laminated within the interior to also eliminate any sharp edges.

Numerous characteristics, advantages and embodiments of the invention have been described in detail in the foregoing description with reference to the accompanying drawings. However, the disclosure is illustrative only and the invention is not limited to the precise illustrated embodiments. Various changes and modifications may be effected therein by one skilled in the art without departing from the scope or spirit of the invention.

We claim:

1. In a fiberboard container for containing flowable materials within a fluid impervious bag inserted within the container, the container having a tubular carton body with a pair of opposed side panels and a pair of opposed end panels wherein each of said panels are separated by fold lines, said pairs of panels being generally normal to each other, each of said side panels and said end panels having a bottom closure flap hingedly connected thereto, and wherein said bottom flaps are delineated from said side and end panels by a bottom longitudinally extending fold line, the improvement comprising:

diagonal fold lines positioned on one bottom flap, said diagonal fold lines extending from said bottom longitudinally extending fold line to the outer edge of said one bottom flap;

said one bottom flap joined to adjacent bottom flaps and delineated from one of the adjacent bottom flaps by at least one bottom flap transverse fold line perpendicular to said bottom longitudinally extending fold line, and delineated from the other adjacent bottom flap by at least one bottom flap transverse fold line perpendicular to said bottom longitudinally extending fold line to thus make said one bottom flap and said adjacent bottom flaps a continuous bottom flap structure, the remaining bottom flap being separated from the continuous bottom flap structure by a slit;

said one bottom flap and said adjacent bottom flaps being folded about said bottom longitudinal fold line and their respective transverse fold lines and diagonal fold lines to form a half bellows bottom closure for the container; and said remaining bottom flap adapted to be folded about said bottom longitudinally extending fold line to thereby be beneath said bottom flap structure and fixed to a pallet to thereby close the bottom of said container and secure the container to the pallet.

2. The container set forth in claim 1 wherein said diagonal fold lines positioned on said one bottom flap divide said one bottom flap into an inner portion, a middle portion, and an outer portion, and wherein when said container is formed, said inner and outer portions are folded along said diagonal fold lines so that the inner and outer portions are positioned between said middle portion and the adjacent bottom flaps.

3. The container as set forth in claim 1 wherein said container is fluid impervious.

4. The packaging system as set forth in claim 3 further comprising a polybag liner within the container to contain a flowable material placed within said container.

5. The container as set forth in claim 1 wherein said diagonal fold lines extend at an angle of 45° with respect to said bottom longitudinally extending fold line.

6. The container as set forth in claim 1 further comprising an interior reinforcing member.

7. The container as set forth in claim 6 wherein said reinforcing member comprises a reinforcing panel laminated to the interior of each of said tubular carton body side panels and end panels.

8. The container as set forth in claim 6 further comprising a polybag liner within the container to contain a flowable material placed within said container.

9. The container set forth in claim 6 wherein said tubular carton body is a double wall corrugated fiberboard and wherein said reinforcing member is a triple wall corrugated fiberboard.

* * * * *